US006595334B1

(12) United States Patent
Saetia

(10) Patent No.: US 6,595,334 B1
(45) Date of Patent: Jul. 22, 2003

(54) BUSINESS CASE WITH REMOVABLE HANDLE AND WHEEL ASSEMBLY

(76) Inventor: Chetthia Saetia, 964 Northpoint Blvd., Lake Villa, IL (US) 60085

( * ) Notice: Subject to any disclaimer, the term of this patent is extended or adjusted under 35 U.S.C. 154(b) by 0 days.

(21) Appl. No.: 10/044,456

(22) Filed: Jan. 10, 2002

(51) Int. Cl.[7] ..... A45C 5/14

(52) U.S. Cl. ..... 190/18 A; 190/102; 190/903; 224/153

(58) Field of Search ..... 190/102, 18 A, 190/114, 108; 280/37, 47.18, DIG. 3; 224/153

(56) References Cited

U.S. PATENT DOCUMENTS

| | | | | | |
|---|---|---|---|---|---|
| 1,099,933 | A | * | 6/1914 | Pohrer | 190/18 A X |
| 3,861,703 | A | * | 1/1975 | Gould | 190/18 A X |
| 3,934,895 | A | * | 1/1976 | Fox | 190/18 A X |
| 4,593,841 | A | * | 6/1986 | Lange | 224/153 |
| 4,596,397 | A | * | 6/1986 | Conti | 190/18 A X |
| 5,323,886 | A | * | 6/1994 | Chen | 190/18 A |
| 5,375,685 | A | * | 12/1994 | Plath | 190/18 A |
| 5,447,261 | A | * | 9/1995 | Mitomi et al. | 224/153 |
| 5,460,307 | A | * | 10/1995 | Stevenson | 224/153 |
| 5,743,363 | A | * | 4/1998 | Rekuc et al. | 190/18 A |
| 5,749,503 | A | * | 5/1998 | Wulf et al. | 224/153 |
| 6,042,127 | A | * | 3/2000 | Rupolo | 280/655.1 X |
| 6,129,254 | A | * | 10/2000 | Yu | 190/18 A X |
| 6,305,587 | B1 | * | 10/2001 | Miller | 224/153 |

FOREIGN PATENT DOCUMENTS

| | | | | |
|---|---|---|---|---|
| JP | 6217826 | * | 8/1994 | 224/153 |

* cited by examiner

*Primary Examiner*—Sue A. Weaver
(74) *Attorney, Agent, or Firm*—Edward J. Chalfie

(57) ABSTRACT

A luggage case is provided with straps or handles for carrying the case and a wheel and an extendable handle assembly for dragging or pulling the case. The wheel and extendable handle assembly is removably attachable to the case, such that it need not be carried when the case is carried by the straps or handles. The wheel and handle assembly are formed as a shell to snugly surround the luggage case. In the preferred embodiment, the case and the shell are joined by mating zippers at the bottom front and top rear edges of the assembly.

11 Claims, 10 Drawing Sheets

BUSINESS CASE WITH REMOVABLE HANDLE AND WHEEL ASSEMBLY

FIELD OF THE INVENTION

The present invention relates to luggage, and more particularly to small luggage cases, such as business cases, computer cases, backpacks and the like which may be provided with shoulder straps or hand grips for carrying, or with wheels for rolling on a surface and an extendable handle for pulling by a user.

BACKGROUND OF THE INVENTION

In the past, most items of luggage, such as those used for overnight travel, were formed of stiff or rigid material as rigid enclosures. Similarly, items of luggage used to carry papers, personal items and other materials to be kept close at hand, particularly when using public transportation, such as airplane or trains, typically referred to as briefcases, where also either made of stiff or rigid material as rigid enclosures, or of rather stiff material such as leather with some flexible portions to permit expansion and contraction. More recently, both types of luggage mentioned above have been formed as relatively unstructured enclosures made of non-rigid natural or man-made materials such as leather, canvas or nylon. The non-rigid material forming the enclosure is assembled to provide luggage of a particular shape. In some cases, a rigid framework is provided to maintain the desired shape of the luggage.

A further development in luggage industry has been the use of wheeled luggage for checked baggage, carry-on baggage and some business cases. For the purposes of this discussion, the term "business case" may include cases designed to hold and transport portable computers. Luggage of this type typically includes wheels and an extendable handle, so that the user can pull the case along on its wheels, without having to bear its full weight. Additional items may be supported by the handle assembly or attached to the case itself, to ease the burden of the user when moving through airport concourses or along city sidewalks. Examples of such additional items are garment bags and other business cases.

The most commonly available luggage of this type has wheels and extendable handle permanently attached to the luggage. When luggage of this type is not being transported on its wheels, the extendable is retracted. When this arrangement is included as part of the design of a business case, the bulk and weight of the case, with its integrated wheel and handle assembly, is are often cumbersome and uncomfortable to carry.

For instance, the same case may be used during business trips and while commuting between home and office. On a business trip the integrated handle and wheel assembly is a blessing; on a commuter train, the bulk and weight of the assembly may be a curse. When such a business case or backpack is carried by shoulder straps or handles, the typically unpadded structure of the retracted handle and wheel assembly can irritate the user's rib cage.

Accordingly, it would be advantageous to provide a luggage system consisting of a case and a wheel and handle assembly which may be readily secured to the case when needed and removed when not needed. Further, it would be desirable to provide the readily removable wheel and handle assembly and the case with complementary devices for securing them to each other. It would be further desirable that the removable wheel and handle assembly and the case be of complementary design, so as to be of pleasing appearance when secured to each other. Finally, it would be desirable that the wheel and handle assembly provide extra strength to the case, particularly when it is fully packed and heavy.

SUMMARY OF THE INVENTION

It is an object of this invention to provide a luggage system which includes a case provided with straps or handles for carrying the case and a wheel and extendable handle assembly for dragging the case. It is a further object of this invention to provide a wheel and extendable handle assembly which may be removably attached to the case.

It is another object of this invention to provide a case with a removable wheel and extendable handle assembly which are attached to each other by complementary fasteners provided on the case and the removable wheel and extendable handle assembly.

It is a still further object of this invention to provide a removable wheel and extendable handle assembly which provides additional protection and rigidity to the case when attached to the case for dragging of the case.

A case with removable wheel and extendable handle assembly in accordance with this invention includes a soft sided case having one or more main storage volumes made accessible by openings which may be held closed by fastening devices. The case may also have additional storage areas for as pockets on the sides of the walls of the main storage areas. Handles are secured to the walls of the main storage area for a person to grasp while carrying the case. In of the preferred embodiments of this invention, straps are secured to the walls of the main storage area which may be used to carry to case as a back pack. A removable wheel and extendable handle assembly in accordance with this invention includes a partial housing having a base, sides and a back. A pair of wheels are mounted on the partial housing adjacent the corners formed by the base, sides and back. The back is provided with an arrangement for telescopically receiving an extendable handle assembly. In a preferred embodiment of this invention, the back of the partial housing is of essentially the same height as the case, the base is of essentially the same width and depth as the case, and the sides are of reduced height as compared to the back. Complimentary fastening devices are provided on the removable wheel and extendable handle assembly and on the case, the removable secure the assembly to the case. In a preferred embodiment of this invention, the complimentary fastening devices are in the form of zippers, similar to those used to provide access to the main storage volume and the auxiliary storage volumes. More particularly, one portion of a zipper is secured around the edge of the back of the partial housing, while the other portion of the zipper is provided on the case, such that when the case is place in the partial housing, the zipper portions may be secured to each other in the usual manner. Similarly, one portion of a zipper may be provided on the edge of the bottom opposite the back, and the other portion on the case, such that when the case is placed in the partial housing, the zipper portions may be secured to each other in the usual manner.

DETAILED DESCRIPTION OF THE PREFERRED EMBODIMENT

Figure 1:
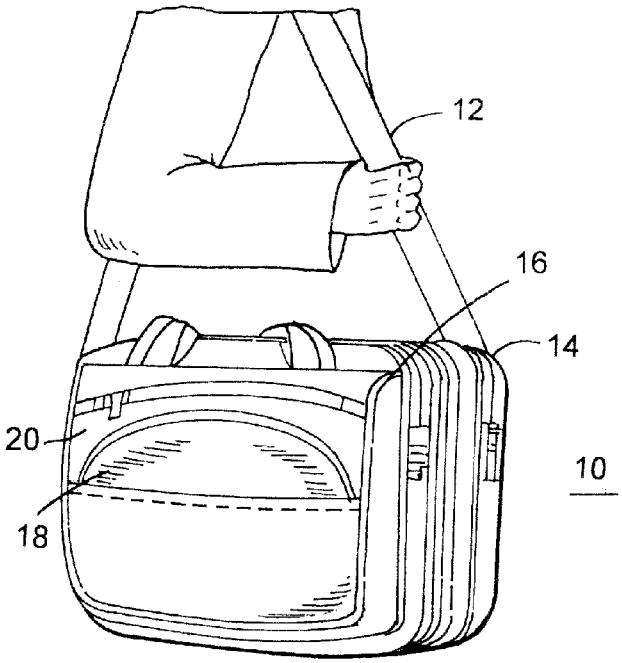
FIG. 1 is a general perspective view of a business case in accordance with the preferred embodiment of this invention transported as a brief case.

Referring to FIG. 1, a business case 10 in accordance with a preferred embodiment of this invention is provided with a shoulder strap 12 so as to be carried by the user. Business case 10 is generally of a rectangular shape, with access being provide to three main storage compartments by zippers 14 and 16. Auxiliary storage compartments 18 and 20 are provided on one side of the case 10.

Figure 2:
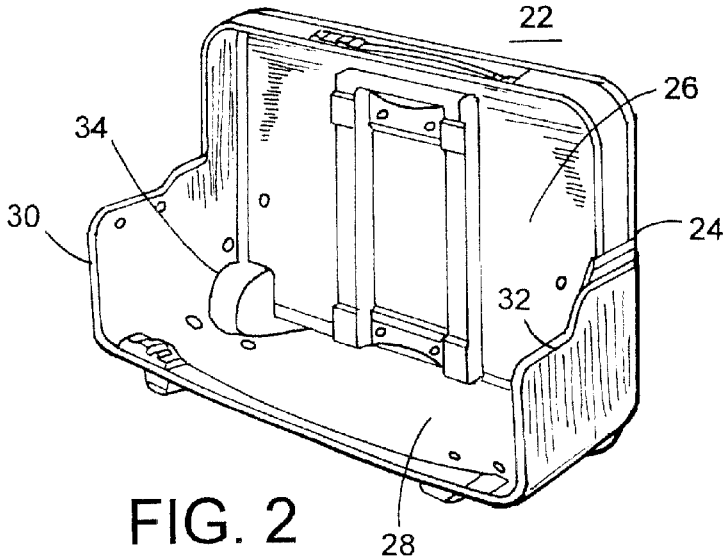
FIG. 2 is a perspective view of a removable wheel and extendable handle assembly in accordance with this invention for use with the case shown in FIG. 1.
Figure 8:
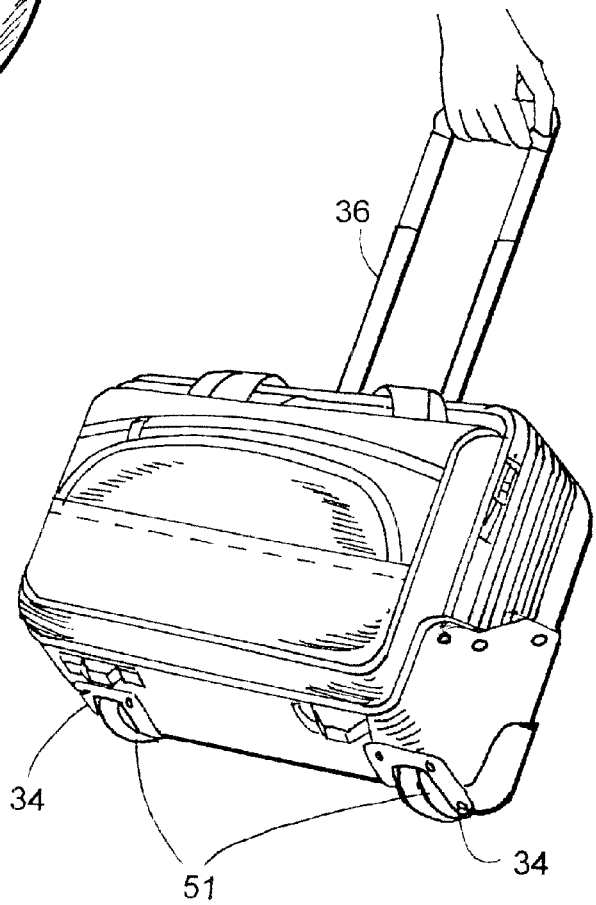
FIG. 8 is a perspective view showing the case of FIG. 1 secured in the removable wheel and extendable handle assembly of FIG. 2, with the extendable handle extended and being used to pull the case.

Referring to FIG. 2, wheel and handle assembly 22 in accordance with this invention is shown to include a partial housing shell 24. Shell 24 includes back 26, base 28 and side members 30 and 32. Wheel housings 34 are formed in the rear base of shell 24. Wheels 52 are rotatably mounted within wheel housings 34 as shown in FIG. 8. Telescoping extendable handle 36 is slidably mounted to the interior of shell back 26 by upper bracket 38 and lower bracket 40. Shell back 26 includes surround gusset 42 which extends around the upper perimeter of shell back 26 to form a flexible top and upper sides of shell 24. Access zipper 44 is provided in surround gusset 42 to provide access, when open, for handle 36, and through which handle 36 is extended.

Upper zipper half 46 is stitched to the leading edge of surround gusset 42. Lower zipper half 48 is stitched to the leading edge of shell base 28. Support feet 50 are provided on the bottom of base 28.

Figure 4:
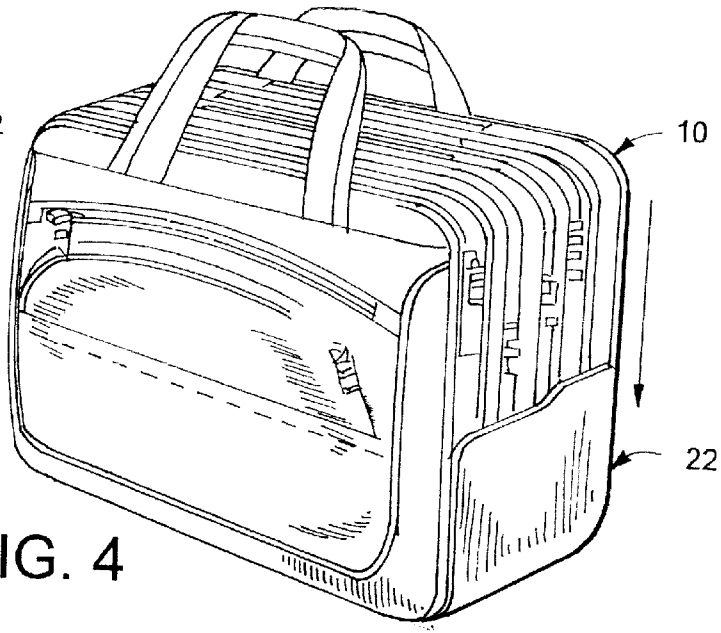
FIG. 4 is a perspective view showing the case of FIG. 1 placed in the removable wheel and extendable handle assembly of FIG. 2.
Figure 3:
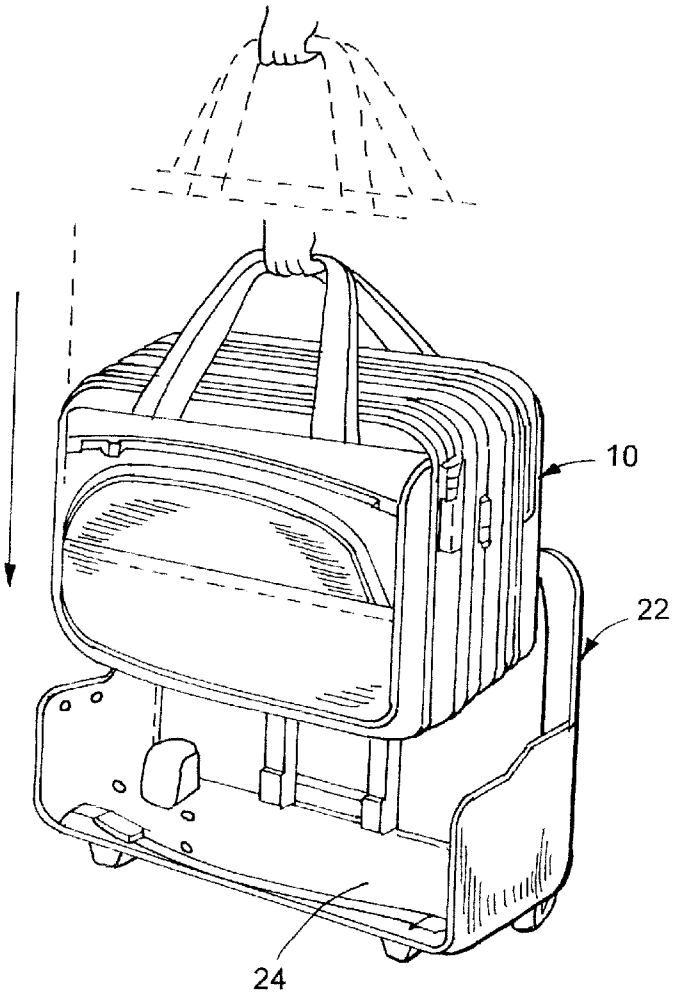
FIG. 3 is a perspective view showing the manner of placement of the case of FIG. 1 in the removable wheel and extendable handle assembly of FIG. 2.

Referring to FIGS. 3 and 4, business case 10 is shown being lowered and inserted in housing shell 24 of wheel and handle assembly 22. Shell 24 is sized to provide a snug fit around case 10.

Figure 5:
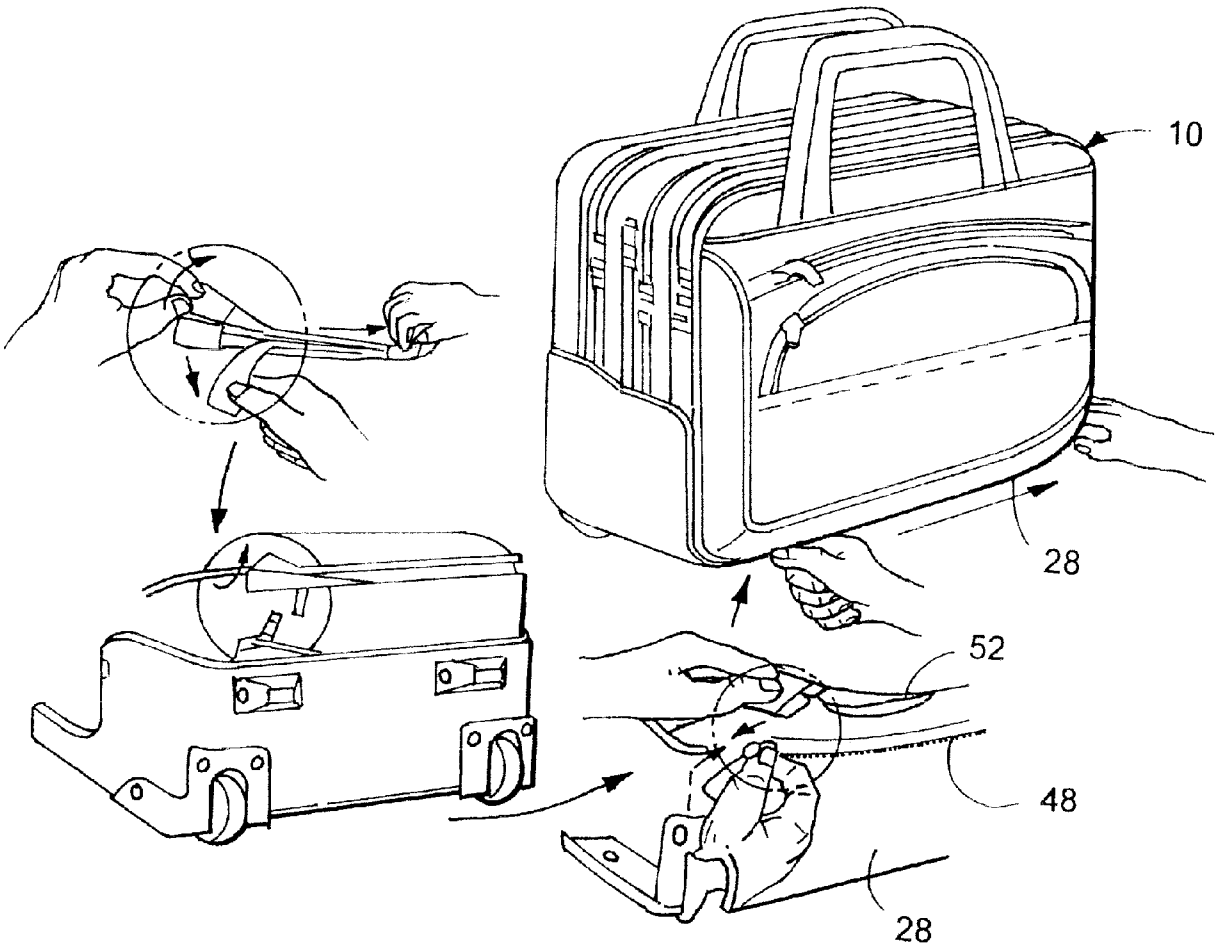
FIG. 5 is a front perspective view showing the case of FIG. 1 placed in the removable wheel and extendable handle assembly of FIG. 2, and a series of detail figures illustrating the attachment process at the bottom of the combined assembly.

Referring to FIG. 5, business case 10 is attached to the leading edge of shell base 28. The means of attachment in the illustrated embodiment zippers at the front bottom edge of the assembly and at the back top and sides of the assembly. It is anticipated, however, that other suitable attaching means could be used, including snaps and hook and loop fastening means. In addition, it is anticipated that the fastening means used in the various embodiments of the present invention could be lockable to secure business case 10 to shell base 28. In this embodiment, the lower frontal attachment is made by mating zipper half 52, stitched to the front bottom edge of case 10, and lower zipper half 48, stitched to the leading edge of shell base 28.

Figure 6:
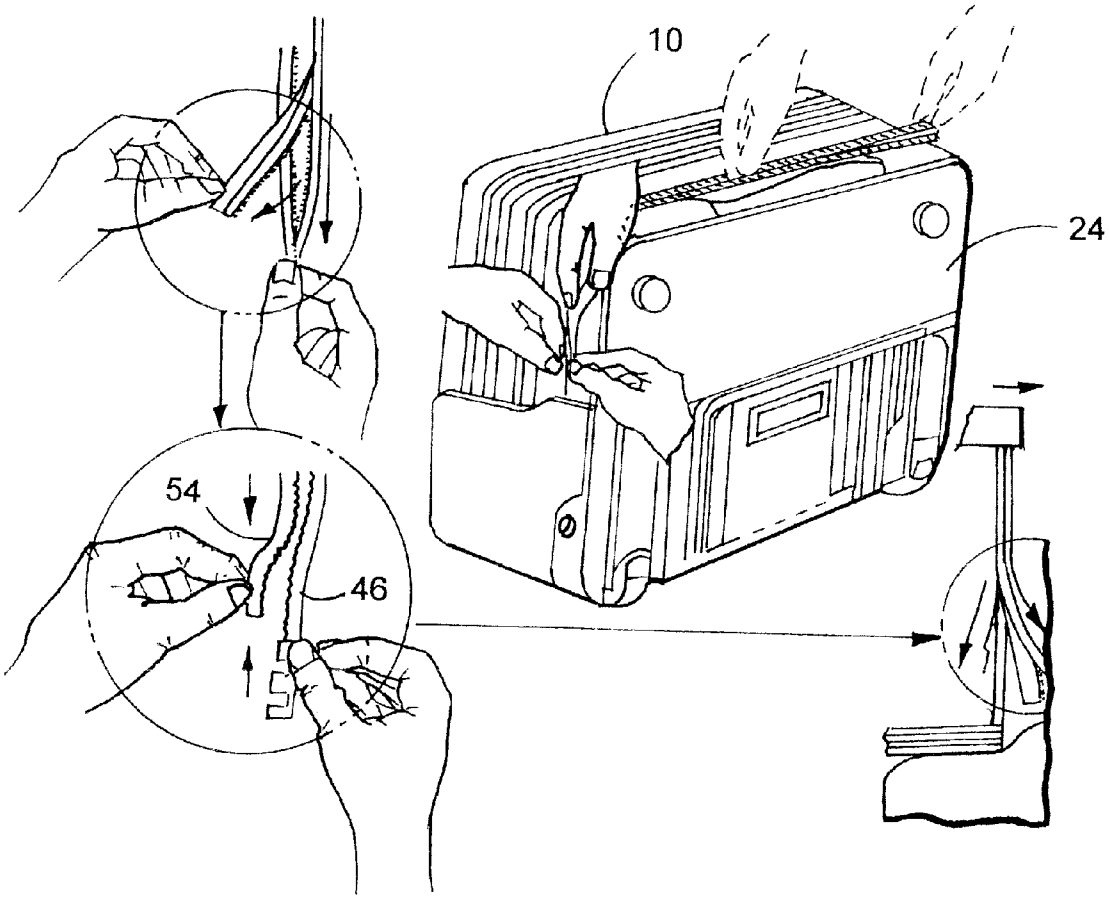
FIG. 6 is a rear perspective view showing the case of FIG. 1 placed in the removable wheel and extendable handle assembly of FIG. 2, and a series of detail figures illustrating the attachment process at the top and sides of the combined assembly.

Similarly, as shown in FIG. 6, zipper half 54, stitched adjacent to and around the upper rear sides and the top rear edge of case 10, and upper zipper half 46 on shell 24 are sized and locate to mate, forming a complete zipper around the rear top edge and upper rear sides of the assembly.

Figure 7:
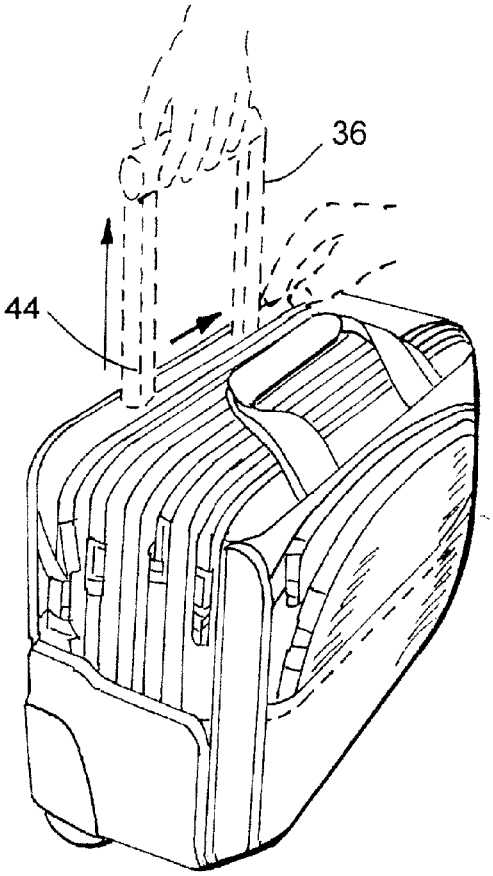
FIG. 7 is a perspective view showing the case of FIG. 1 being finally secured in the removable wheel and extendable handle assembly of FIG. 2, with the extendable handle partially extended.

FIGS. 7 and 8 illustrate the completely assembled unit. In FIG. 7, Telescoping extendable handle 36 is extracted from access zipper 44 so that the case may be pulled behind the user.

Figure 9:
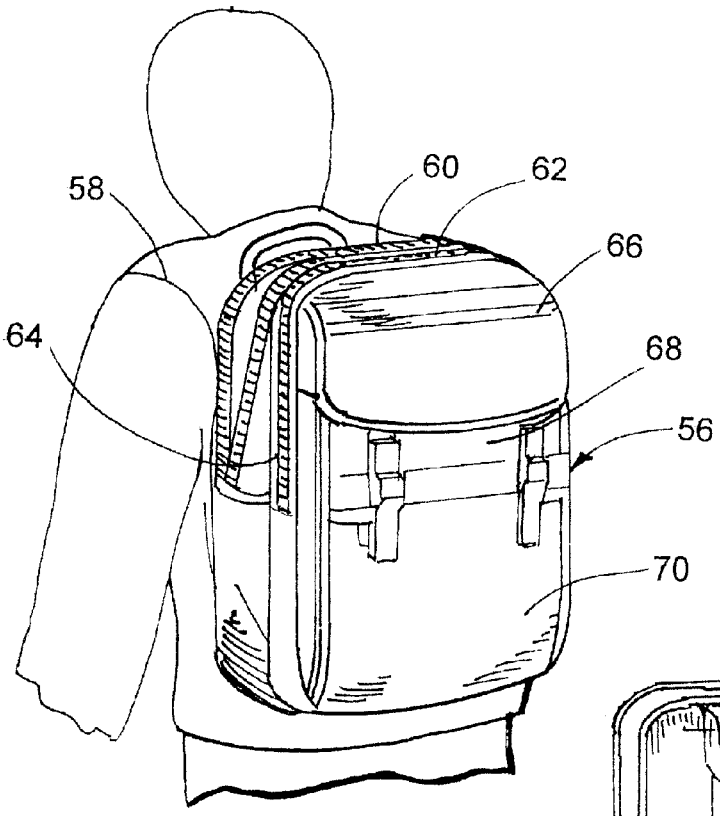
FIG. 9; is a general perspective view of a back pack in accordance with an alternative embodiment this invention.
Figure 10:
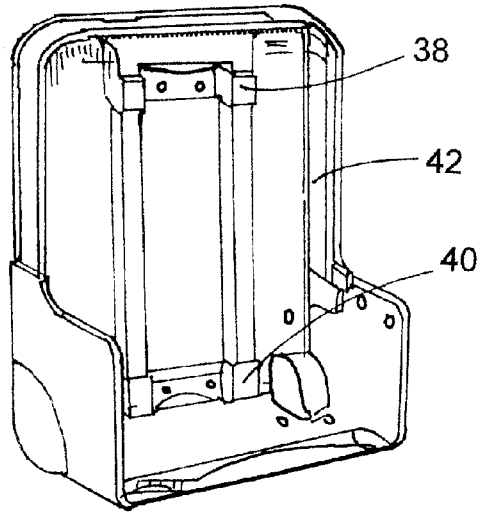
FIG. 10 is a perspective view of a removable wheel and extendable handle assembly in accordance with this invention for use with the case shown in FIG. 9.
Figure 11:
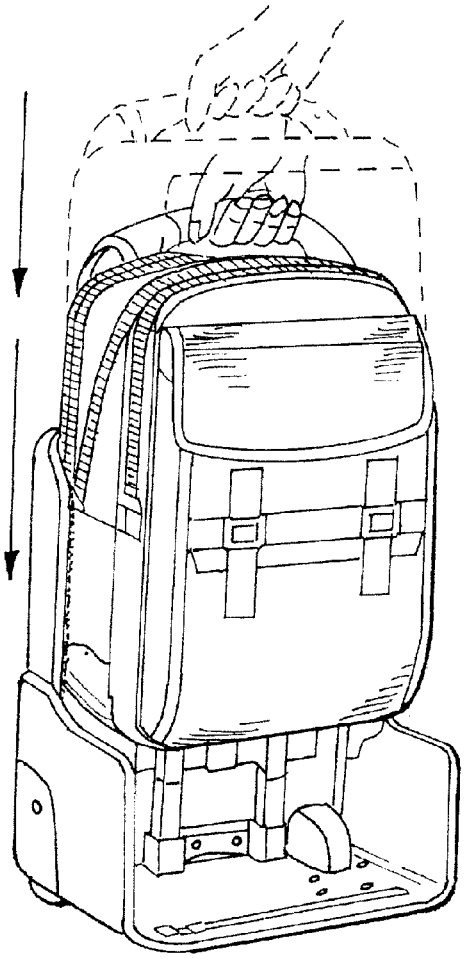
FIG. 11 is a perspective view showing the manner of placement of the case of FIG. 9 in the removable wheel and extendable handle assembly of FIG. 10.
Figure 12:
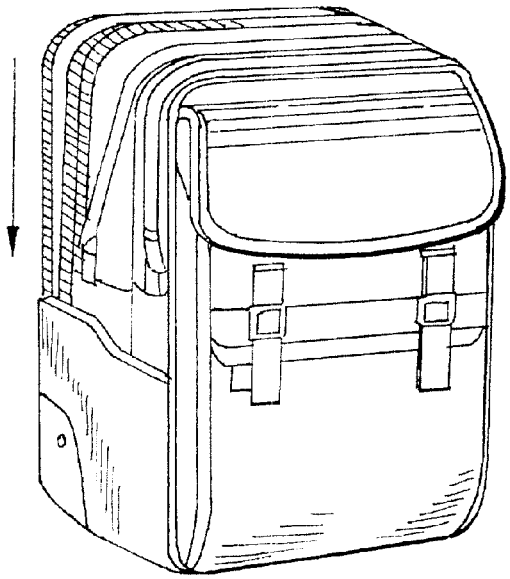
FIG. 12 is a perspective view showing the case of FIG. 9 placed in the removable wheel and extendable handle assembly of FIG. 10.
Figure 13:
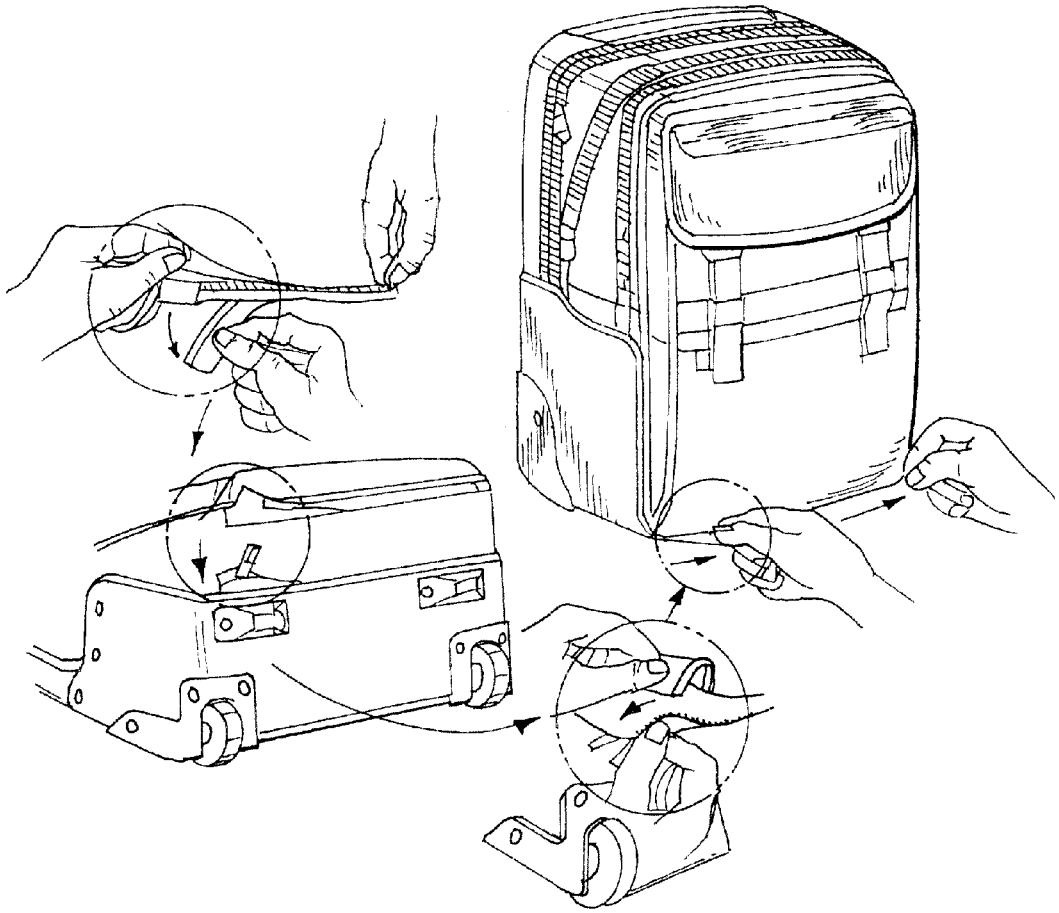
FIG. 13 is a perspective view showing the case of FIG. 9 placed in the removable wheel and extendable handle assembly of FIG. 10, and a series of detail figures illustrating the attachment process at the bottom of the combined assembly.
Figure 14:
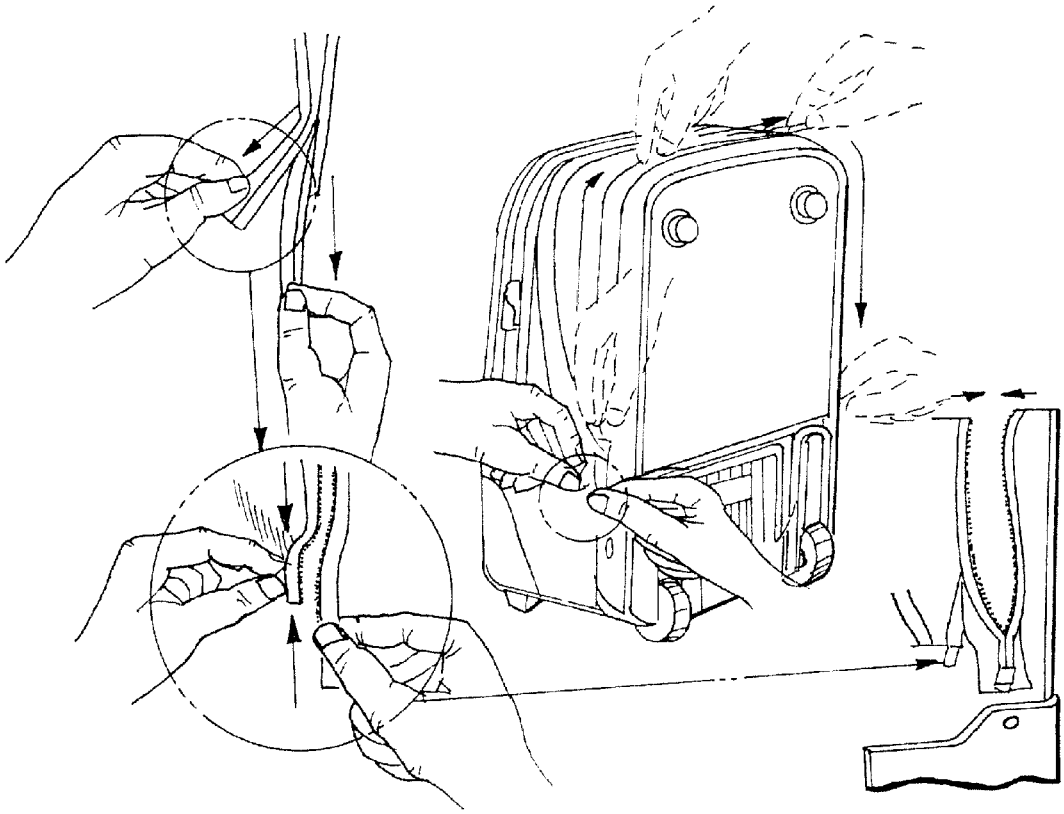
FIG. 14 is a perspective view showing the case of FIG. 9 placed in the removable wheel and extendable handle assembly of FIG. 10, and a series of detail figures illustrating the attachment process at the top and sides of the combined assembly.
Figure 15:
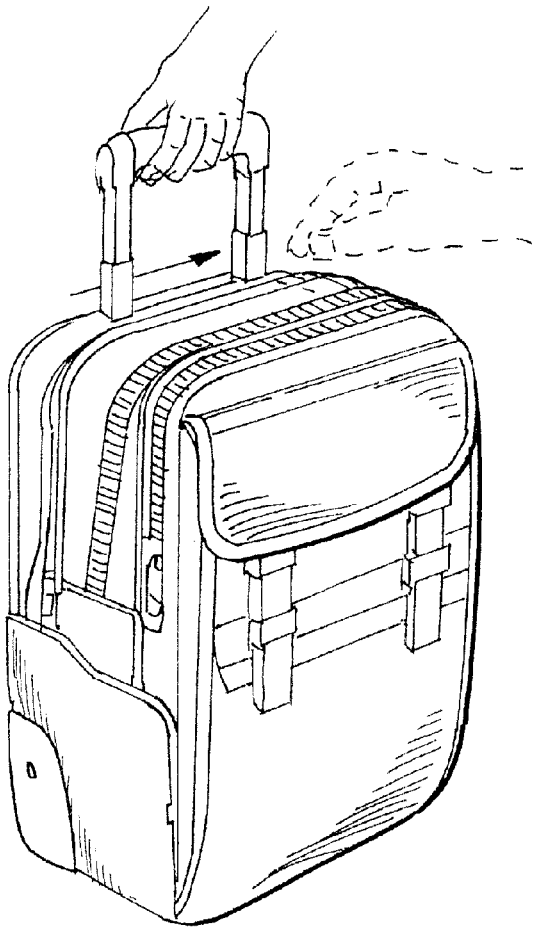
FIG. 15 is a perspective view showing the case of FIG. 9 being finally secured in the removable wheel and extendable handle assembly of FIG. 10, with the extendable handle partially extended.
Figure 16:
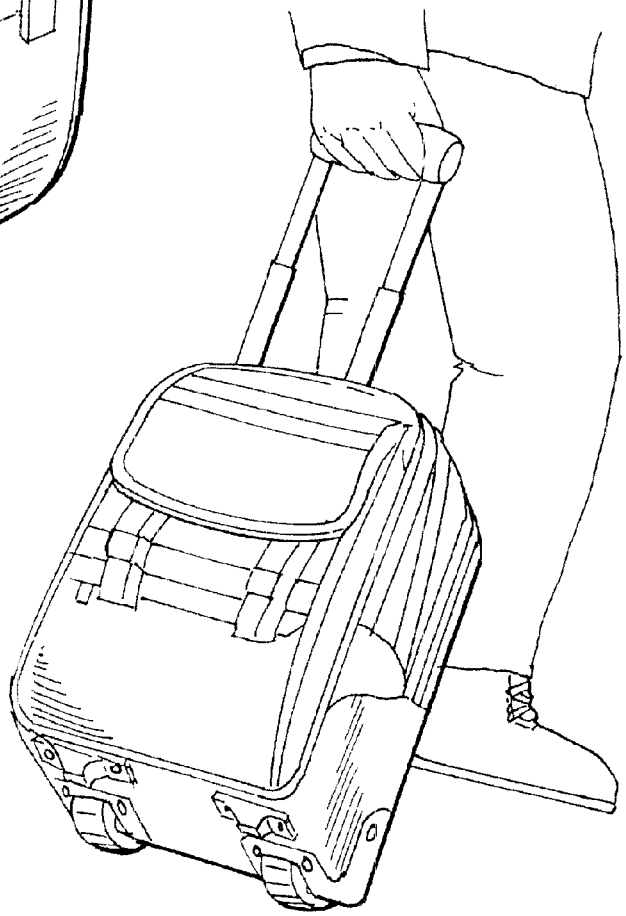
FIG. 16 is a perspective view showing the case of FIG. 9 secured in the removable wheel and extendable handle assembly of FIG. 10, with the extendable handle extended and being used to pull the case.

An alternative embodiment of the present invention is shown in FIGS. 9–16. Referring to FIG. 9, back pack 56 is provided with a pair of shoulder straps 58, one of which is shown, so as to be carried by the user. The back pack 56 is generally of a rectangular shape, with access being provided to three main storage compartments by zippers 60, 62, and 64. Auxiliary storage compartments 66, 68, 70 are provided on one side of back pack 56. This embodiment of the present invention differs from the previously described embodiment only in that back pack 56 is vertical in aspect rather than horizontal like business case 10 of the first described embodiment.

While only two embodiments of the invention have been shown, it should be apparent to those skilled in the art that what has been described is considered at present to be a preferred embodiment of the roller wheel assembly for a tracked vehicle of this invention. In accordance with the Patent Statute, changes may be made in the roller wheel assembly for a tracked vehicle without actually departing from the true spirit and scope of this invention. The appended claims are intended to cover all such changes and modification which fall in the true spirit and scope of this invention.

What is claimed is:

1. A luggage case system comprising:

a case having a top, bottom, front, back and sides, a wheel and handle assembly, comprising a partial housing including a bottom, a back, and sides, an extendable handle secured to said back, said partial housing conforming in shape to that of said case, such that said bottom of said case may be placed on the bottom of the partial housing, and said back and sides of said case will engage the back and sides of said partial housing, complementary readily releasable securing devices being provided on said case and said partial housing such that said case may be secured to said wheel and handle assembly, whereby with said handle extended said case may be pulled by said handle.

2. The luggage case system of claim 1, wherein said complementary releasable securing device is at least one zipper formable by mating zipper halves attached to said case and said housing, respectively.

3. The luggage case system of claim 1, wherein said complementary releasable securing device is a hook and loop fastener.

4. The luggage case system of claim 1, wherein said complementary releasable securing device is formed by mating snaps.

5. The luggage case system of claim 1, wherein said partial housing of said wheel and handle assembly is formed of a rigid material.

6. The luggage case system of claim 5, wherein said back of said partial housing is of the same height as said case, and said bottom is of approximately the same size as the bottom of said case.

7. The luggage case system of claim 6, wherein said sides of said housing are substantially as wide as said sides of said case and shorter than the height of said back of said housing.

8. The luggage case system of claim 5, wherein said partial housing is formed of plastic.

9. The luggage case system of claim 1, wherein said case is formed of a wear-resistant fabric.

10. The luggage case system of claim 1, wherein said case is a business case.

11. The luggage case system of claim 1, wherein said case is a back pack.

* * * * *